United States Patent [19]

Pooley et al.

[11] Patent Number: 4,872,856

[45] Date of Patent: Oct. 10, 1989

[54] ELECTRICAL CONNECTOR

[75] Inventors: Denis M. Pooley, Oshawa; Douglas K. MacKenzie, deceased, late of Markham, both of Canada, by Russell U. MacKenzie, administrator

[73] Assignee: AMP Incorporated, Harrisburg, Pa.

[21] Appl. No.: 323,638

[22] Filed: Mar. 15, 1989

[51] Int. Cl.[4] ..... H01R 11/01

[52] U.S. Cl. ..... 439/783; 439/863

[58] Field of Search ..... 439/783, 863

[56] References Cited

U.S. PATENT DOCUMENTS

| | | | |
|---|---|---|---|
| 4,600,264 | 7/1986 | Counsel | 439/783 |
| 4,723,920 | 2/1988 | Werner | 439/783 |
| 4,723,921 | 2/1988 | Pooley | 439/783 |
| 4,734,062 | 3/1988 | Goto | 439/783 |
| 4,813,894 | 3/1989 | Mixon, Jr. | 439/783 |

*Primary Examiner*—P. Austin Bradley

*Attorney, Agent, or Firm*—Allan B. Osborne

[57] ABSTRACT

An electrical connector for electrically commoning a pair of conductors. More particularly, the connector includes a pair of pivoting toggle blocks which are inserted longitudinally into a C-member at an angle so the combined width is less than the space between conductors disposed in channels in the C-member. As the toggle blocks engage ramps in the C-member, the blocks are forced into a parallel relation to each other, the combined width of which exceeds the aforementioned space whereby the conductors are compressed in the connector and electrically commoned thereby.

3 Claims, 5 Drawing Sheets

ELECTRICAL CONNECTOR

FIELD OF THE INVENTION

This invention relates to an electrical connector for electrically and mechanically connecting two conductors together. More particularly, the connector is of the type including a C-shaped member and toggle blocks which compress the conductors into parallel channels in the C-shaped member.

BACKGROUND OF THE INVENTION

Electrical connectors of the type having a C-shaped body member having converging channels and a complementary wedge member have been known from at least as early as Apr. 21, 1931 when U.S. Pat. No. 1,801,277 issued to W. G. Kelley on an application filed May 18, 1926. ; Subsequent thereto, a large number of patents disclosing different and improved embodiments have issued, including more recently U.S. Pat. Nos. 3,212,534, 4,600,264 and 4,723,921. In each of the disclosures, the basic Kelley concept was followed; i.e., two conductors are electrically and mechanically connected by being pressed into and against interior curved surfaces or channels provided in a C-shaped body member by a wedge being forced into the body member between the conductors. In each of the latter three disclosures however, a different mechanism was used to effect the termination. As disclosed in Pat. No. 3,212,534, an explosively driven ram drove the wedge longitudinally into the C-member. A bolt, threadedly received in an aperture in the C-member, was used to draw the wedge into engagement with the conductors, was disclosed in Pat. No. 4,600,264. In a departure from prior disclosures, Pat. No. 4,723,921 teaches the use of toggle blocks which are forced into the C-member in a direction normal to the interior, conductors receiving curved surfaces.

It is now proposed to combine the toggle blocks of Pat. No. 4,723,921 with the longitudinal movement disclosed in the earlier patents.

SUMMARY OF THE INVENTION

According to the invention, an electrical connector is disclosed which includes a pair of toggle blocks and a C-member. The C-member includes a pair of spaced apart, conductor-receiving channels and at least one ramp converging towards a space between conductors which may be in the channels. The pair of toggle blocks, pivotally engaging each other, are inserted longitudinally into the space initially at an angle relative to each other so that the combined width thereof is less than the space until the blocks engage and slide along the ramp which forces the blocks into a parallel relation and thereby compress the conductors which may be in the channel.

DESCRIPTION OF THE INVENTION

Figure 1A:
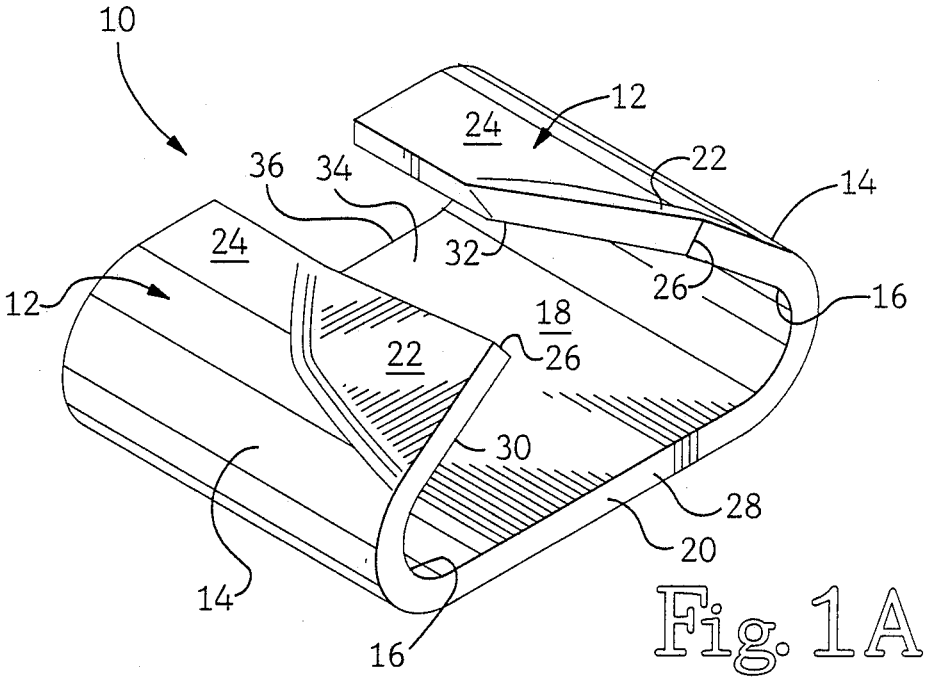
FIG. 1A is a perspective view of the C-member of the electrical connector of the present invention.

The electrical connector of the present invention, indicated by reference numeral 76 (FIG. 3A for example) provides a means for electrically commoning a pair of utility wires of cables; i.e., conductors. Connector 76 includes a C-member 10 and a pair of toggle blocks 40,42.

Figure 1B:
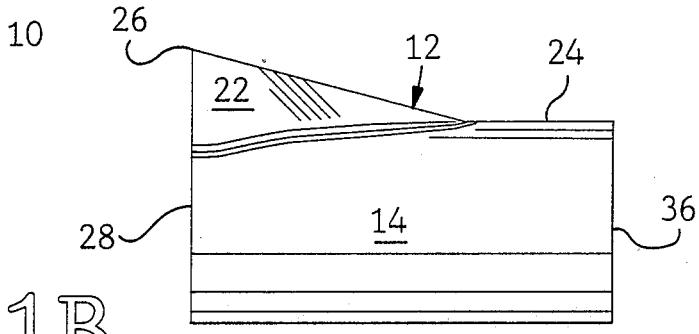
FIGS. 1B and 1C are respective side and end views of the C-member.
Figure 1C:
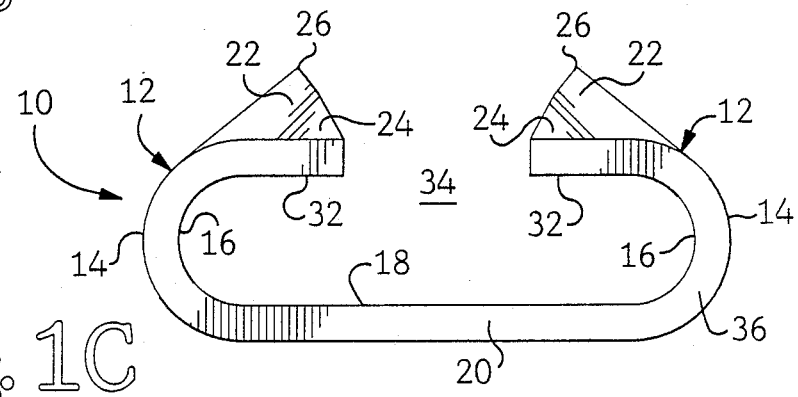

Referring now to FIGS. 1A, 1B and 1C, C-member 10 is preferably extruded with the longitudinal edges 12 rolled over to define channel portions 14 which include parallel, inwardly-facing curved channels 16. Channels 16 face each other across surface 18 of wall 20 which extend between and join channel portions 14. Channels 16 are dimensioned to conformably receive a modest range of wire sizes; e.g., from 795 26/7 ACSR to 636–37 AAC.

Both longitudinal edges 12 include first and second portions 22,24 respectively which extend inwardly from channel portion 14 and which overlie wall 20. Free corner 26 of first portions 22, which is adjacent first end 28 of member 10, has been pulled back and out so that first portions 22 project obliquely outwardly. This structure defines ramps 30 on inside surfaces 32 on each first portion 22. As shown, ramps 30 converge towards space 34, which is the semi-closed area defined by channels 16, wall 20 and portions 22,24, in the direction of second portions 24. Second portions 24 are parallel to wall 20 and extend from the connection with first portions 22 to second end 36 of C-member 10. As indicated by FIG. 1-B, second portion 24 is about one-third shorter than first portion 22.

C-member 10 is preferably extruded and portions 22 formed obliquely outwardly as a secondary operation. The preferred material is 6061-T-6 aluminum.

Figure 2A:
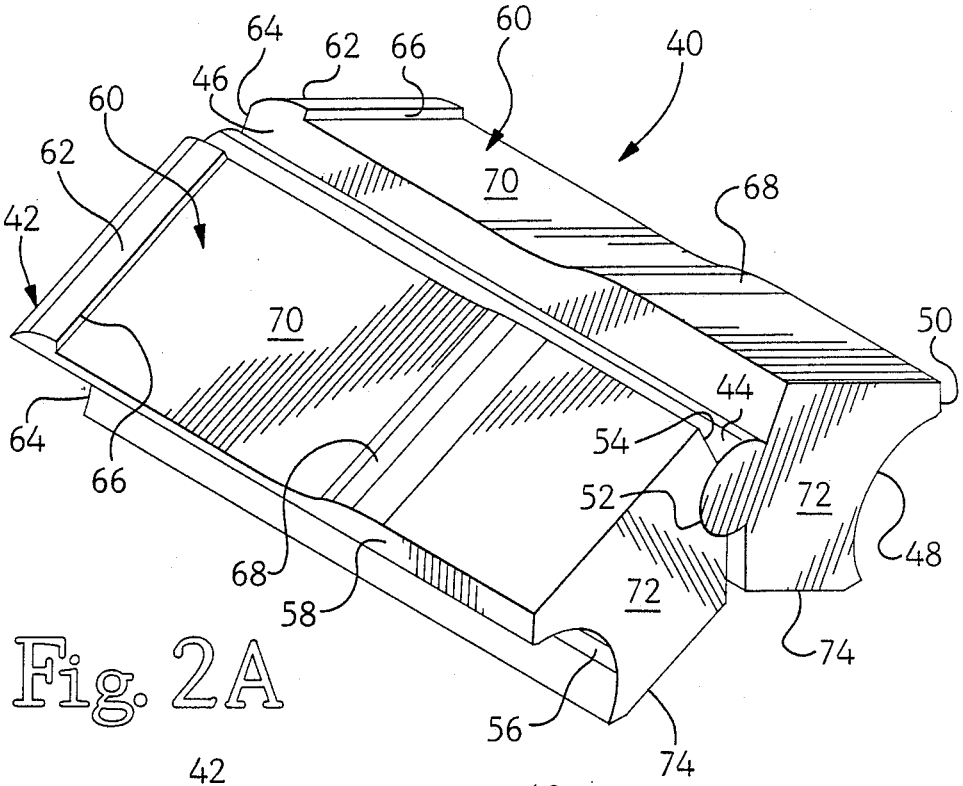
FIG. 2A is a perspective view of the toggle blocks of the electrical connector of the present invention.
Figure 2B:
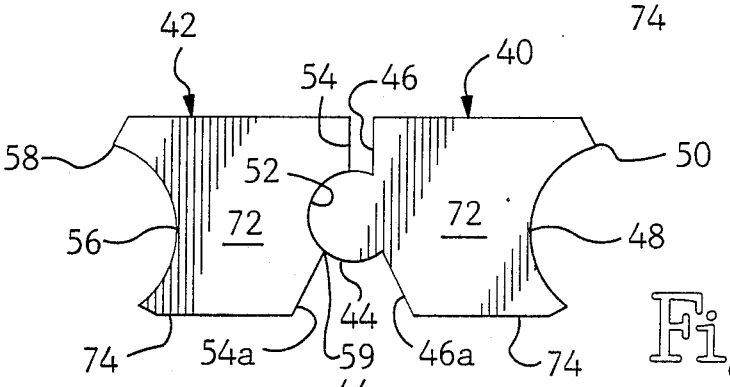
FIGS. 2B and 2C are end views of the toggle blocks.
Figure 2C:
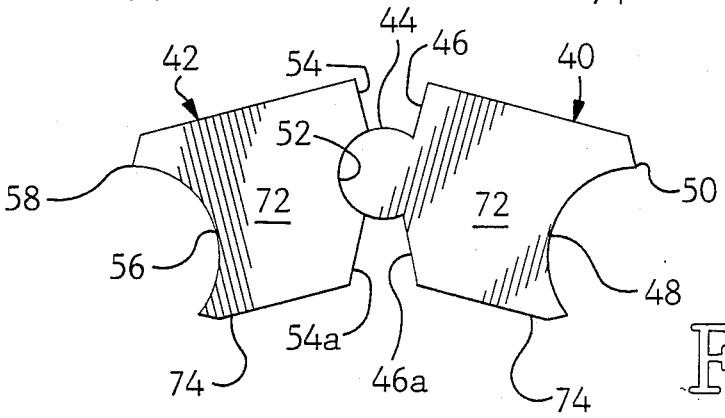

Toggle blocks 40,42, shown in FIGS. 2A, 2B, and 2C, may be extruded with the material being 6061-T-6 aluminum.

Secondary operations are required as will be obvious to one skilled in the art. Alternatively, blocks 40,42 may be cast to avoid such secondary operations.

Toggle block 40 includes an exteriorly curved or arcuate pivoting rail 44 extending longitudinally along inner side 46 and an interiorly curved channel 48 extending longitudinally along outer side 50.

Toggle block 42 includes an interiorly curved, pivoting groove 52 extending longitudinally along inner side 54 and an interiorly curved channel 56 extending longitudinally along outer side 58. As indicated in the drawings, pivoting rail 44 on block 40 and pivoting groove 52 on block 42 provide pivoting surfaces 59 which conformably and pivotally engage each other such as in a ball and socket joint.

As shown clearly in FIG. 2B, inner side portions 46a and 54a; i.e., the portions of sides 46,54 below rail 44 and groove 52 respectively, are beveled outwardly so that blocks 40,42 may pivot freely over a given distance such as shown in FIG. 2C.

Top surfaces 60 on both blocks 40,42 are identical and include a forwardly facing camming portion 62 at the top edge of leading end 64. Rearwardly facing shoulders 66 and forwardly facing inclined portions 68 define therebetween depressed area 70. As shown, area 70 occupies about one half of the length of top surface 60.

Leading ends 64, trailing ends 72 and base surfaces 74 of blocks 40,42 are flat across.

As will be more fully developed below, the width of blocks 40,42 when joined together as shown in FIG. 2B is predetermined to cooperate with C-member 10 in terminating pairs of conductors of a given diameter.

Electrical connector 76 of the present invention is an assembly of C-member 10 and toggle blocks 40, 42 as shown in the succeeding figures.

Figure 3A:
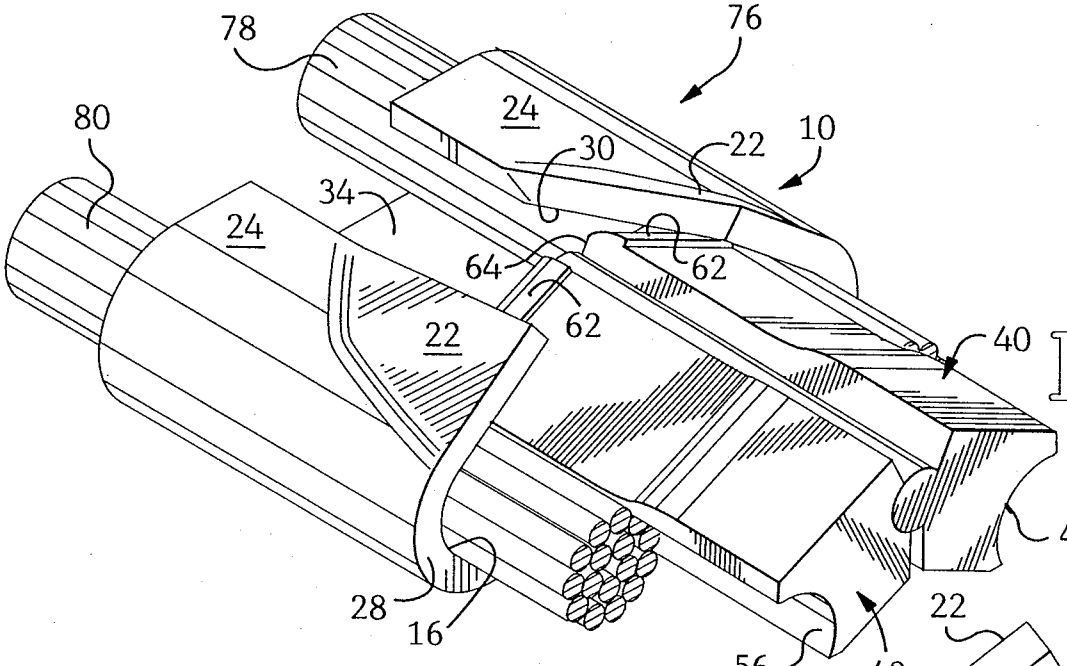
FIG. 3A is a perspective view and FIG. 3B is an end view of the partly assembled electrical connector.
Figure 3B:
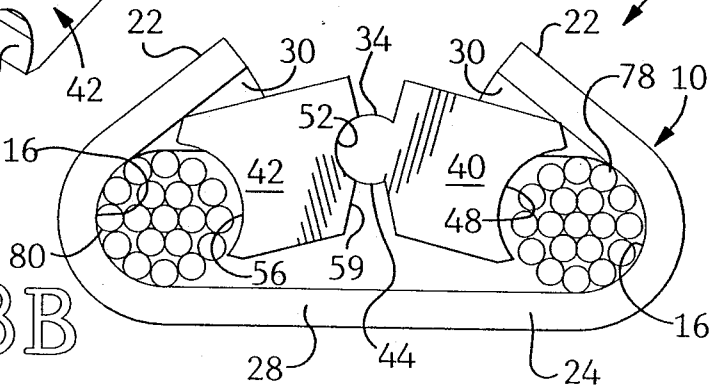

FIGS. 3A and 3B are views showing the initial step in terminating cables 78,80 in electrical connector 76. Conductors 78,80 are first placed in respective channels 16. Toggle blocks 40,42, engaged along pivoting surfaces 59 are pivoted so as to reduce the combined width thereof and then inserted into space 34 with channels 48,56 engaging conductors 78,80 respectively. As shown in FIG. 3A, leading ends 64 of blocks 40,42 are inserted into end 28 of C-member 10 so that camming portions 62 will engage ramps 30.

Figure 4A:
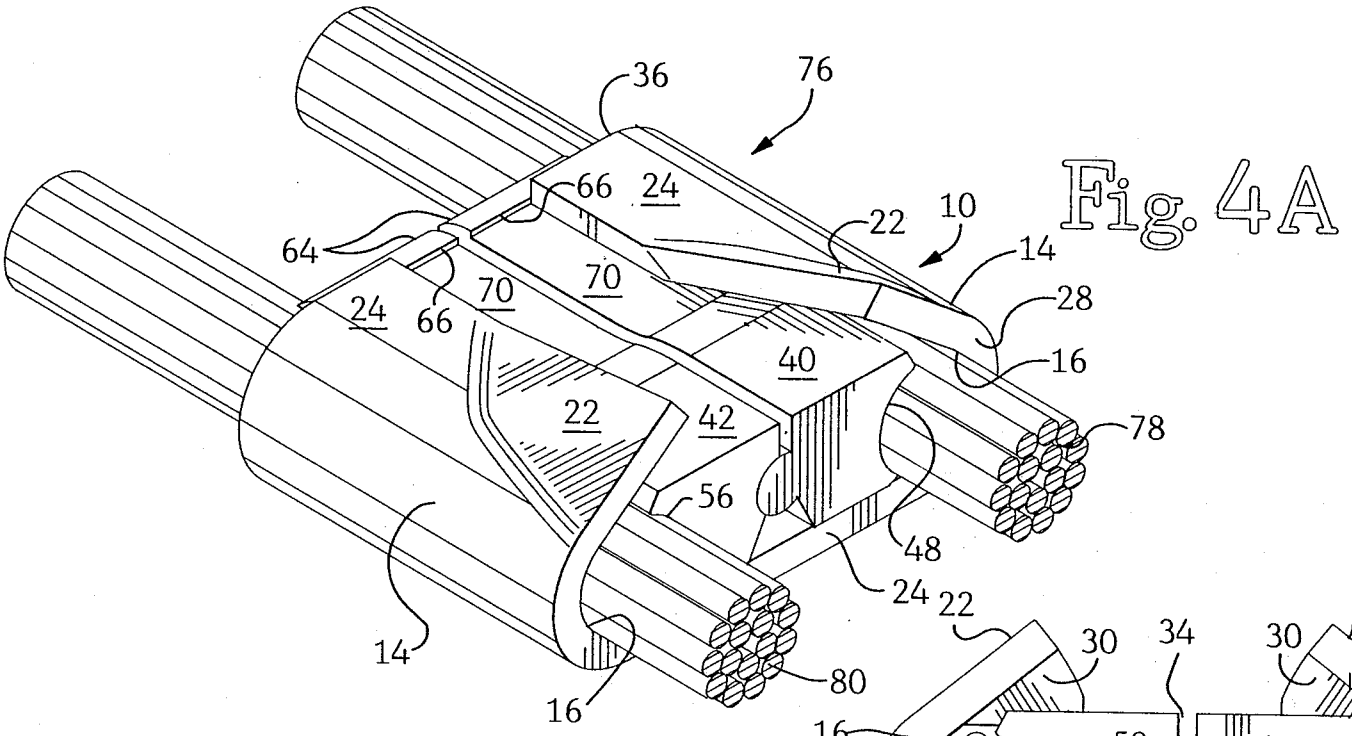
FIG. 4A is a perspective view.
Figure 4B:
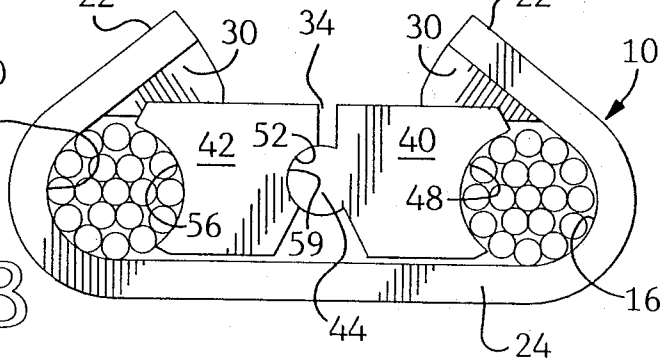
FIG. 4B is an end view and FIG. 4C is a top plane view of the assembled electrical connector.
Figure 4C:
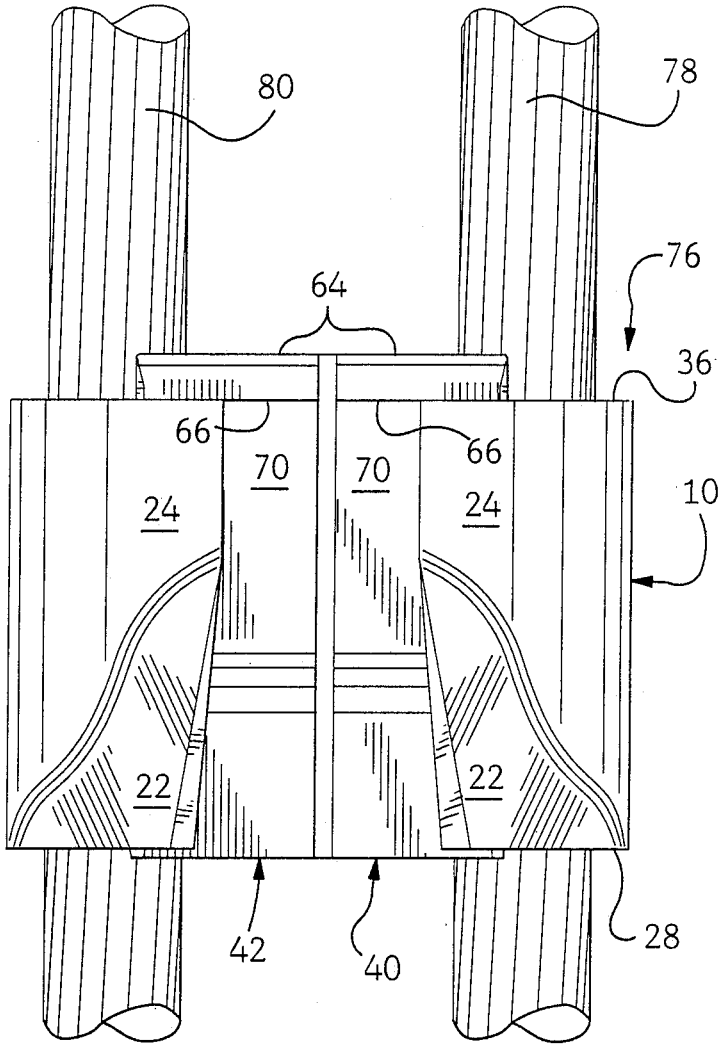

Thereafter, blocks 40,42 are driven into C-member 10 as shown in FIGS. 4A, 4B and 4C. In being driven longitudinally into C-member 10, toggle blocks 40,42 are forced to flatten out by reason of the engagement thereof with ramps 30 and second portions 24. In the course of blocks 40,42 being flattened out, the individual strands of conductors 78,80, positioned between respective channels 16 and channels 48,56 respectively, roll and rub against each other. This action, as is well known, beneficially scrubs oxides and contaminants off the strands.

As noted above, the combined width of toggle blocks 40,42 in a FIG. 2B relation; i.e. parallel to each other has been pre-determined so that, when flattened out; i.e., in a parallel relation in C-member 10, conductors 78,80 are compressed tightly therein to effect a good electrical connection. Further, and preferably, channel portions 14 of C-member 10 are resiliently forced outwardly so that a continuous pressure is exerted against conductors 78,80.

Toggle blocks 40,42 are locked in C-member 10 by reason of leading end 64 of blocks 40,42 passing beyond second end 36 of C-member 10 and second portions 24 thereof resiliently dropping into depressed areas 70 behind and in abutting relation with rearwardly facing shoulders 66.

As can be discerned an electrical connector for electrically commoning two conductors has been disclosed. The connector includes a C-member having parallel conductor receiving channels and interior ramps converging on the space in the C-member which receives a pair of toggle blocks. The toggle blocks which have a pre-determined combined width when in a parallel relation, enter the C-member at an angle to each other so that the combined width is less than the space between the conductors disposed in the channels. As the toggle blocks are driven longitudinally into the C-member, they engage the ramps and are forced into the parallel relation so that the combined width is greater than the space and accordingly the conductors are compressed in the channels.

We claim:

1. An electrical connector for electrically commoning a pair of conductors, said connector comprising:

a C-member having a pair of spaced apart, conductor-receiving channels and at least one ramp converging towards a space between conductors which may be disposed in said channels; and a pair of toggle blocks pivotally engaging each other along one side and having a combined width when in a parallel relation to each other which is greater than said space, said blocks adapted for insertion into said space initially at an angle relative to each other to provide a smaller combined width until said blocks engage and slide along said ramp whereupon said blocks are forced into a parallel relation and thereby compress the conductors which may be in said channels.

2. The electrical connector according to claim 1 wherein said channels are defined by reversibly-folded over longitudinal edges extending towards each other and overlying a wall of said C-member extending between said channels.

3. The electrical connector according to claim 2 wherein portions of said longitudinal edges overlying said wall and located adjacent one end of said C-member, extend obliquely outwardly to define, on surfaces facing said space, said at least one ramp.

* * * * *